US008529219B2

(12) United States Patent
Takai

(10) Patent No.: US 8,529,219 B2
(45) Date of Patent: Sep. 10, 2013

(54) VARIABLE DISPLACEMENT COMPRESSOR

(75) Inventor: Kazuhiko Takai, Isesaki (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 209 days.

(21) Appl. No.: 12/682,079

(22) PCT Filed: Oct. 1, 2008

(86) PCT No.: PCT/JP2008/067788

§ 371 (c)(1),
(2), (4) Date: Apr. 8, 2010

(87) PCT Pub. No.: WO2009/051006

PCT Pub. Date: Apr. 23, 2009

(65) Prior Publication Data

US 2010/0209272 A1 Aug. 19, 2010

(30) Foreign Application Priority Data

Oct. 19, 2007 (JP) ..... 2007-272719

(51) Int. Cl.
*F04B 49/00* (2006.01)

(52) U.S. Cl.
USPC ..... 417/295; 417/298; 417/441

(58) Field of Classification Search
USPC ..... 417/295, 298, 270, 441
See application file for complete search history.

(56) References Cited

U.S. PATENT DOCUMENTS 5,636,823 A * 6/1997 Boyd ..... 248/414
6,257,848 B1 * 7/2001 Terauchi ..... 417/441
7,651,321 B2 * 1/2010 Ota et al. ..... 417/222.2
7,918,656 B2 * 4/2011 Hibino et al. ..... 417/441
7,931,452 B2 * 4/2011 Hibino et al. ..... 417/295
8,366,407 B2 * 2/2013 Hayashi et al. ..... 417/295
2001/0026762 A1 10/2001 Fujita et al.
2002/0117366 A1 8/2002 Casellas et al.
2003/0145615 A1 * 8/2003 Sasaki et al. ..... 62/228.3
2005/0244279 A1 * 11/2005 Murakami et al. ..... 417/222.2
2006/0165535 A1 * 7/2006 Ota et al. ..... 417/222.2

FOREIGN PATENT DOCUMENTS

JP S50-043527 A 4/1975
JP S61-202690 U 12/1986
JP H02-066332 A 3/1990
JP 2001-289177 A 10/2001
JP 2002-527690 A 8/2002

OTHER PUBLICATIONS

Japanese Patent Office, International Search Report for International Patent Appl'n No. PCT/JP2008/067788, dated Oct. 28, 2008.

* cited by examiner

*Primary Examiner* — Charles Freay
*Assistant Examiner* — Ryan Gatzemeyer
(74) *Attorney, Agent, or Firm* — Baker Botts L.L.P.

(57) ABSTRACT

A variable displacement compressor comprises an opening-degree adjustment valve which is disposed in a flow passage between a suction port and a suction hole communicating with a cylinder bore and variably controls the opening area of the flow passage. The variable displacement compressor is characterized in that the resistance against the movement of the valve body of the opening-degree adjustment valve in the direction of increasing the opening area of the flow passage is made to be greater than the resistance against the movement thereof in the direction of decreasing the opening area. The liquid compression at the starting of the compressor is prevented from occurring, whereby the durability and the reliability of the device can be improved and the device can exhibit excellent displacement control responsiveness.

7 Claims, 6 Drawing Sheets

VARIABLE DISPLACEMENT COMPRESSOR

CROSS-REFERENCE TO RELATED APPLICATIONS

This application is the National Stage of International Patent Application No. PCT/JP2008/067788, filed Oct. 1, 2008, which claims the benefit of Japanese Patent Application No. 2007-272719, filed Oct. 19, 2007, the disclosures of which are incorporated herein by reference in their entirety.

TECHNICAL FIELD OF THE INVENTION

The present invention relates to a variable displacement compressor having an opening-degree adjustment valve which variably controls an opening area of a flow passage, which is also called a suction passage, in the flow passage between a suction port and a suction hole communicating with a cylinder bore, and specifically, relates to a variable displacement compressor which is suitable as a compressor provided in a refrigeration circuit of an air conditioning system for vehicles.

BACKGROUND ART OF THE INVENTION

An opening-degree adjustment valve which variably controls an opening area of a flow passage and which is provided in a flow passage between a suction port and a suction hole communicating with a cylinder bore, of a compressor of an air conditioning system for vehicles, etc., such as shown in FIG. 6, is known. In FIG. 6, symbol 100 implies an opening-degree adjustment valve, and opening-degree adjustment valve 100 having casing 101 and valve body 102 is provided in a flow passage, which is also called a suction passage, between a suction port of a compressor and a suction hole of a cylinder bore, where casing 101 is disposed in the suction passage and valve body 102 is contained in casing 101 movably. Casing 101 is formed in a shape of a cylinder having the bottom, and small opening section 103 and large opening section 104 are formed on a side surface of casing 101. Further, by spring 105 which is provided in casing 101, valve body 102 is urged in a direction of shutting opening 104, which means a direction of decreasing an opening area of the flow passage. Furthermore, even in a condition where valve body 102 is urged by spring 105 in the direction of decreasing the opening area of the flow passage, small opening section 103 is always opened without closing.

In such opening-degree adjustment valve 100, because gas in a suction chamber is sucked into the cylinder bore at the time of the compressor startup, etc., the pressure in the suction chamber decreases, and valve body 102 is pushed downward in FIG. 6, or in a direction of increasing the opening area of large opening section 104, and the opening area of the flow passage increases. On the other hand, when a fluid sucked from a suction port side is decreased at the time of the compressor shutdown, etc., valve body 102 is pushed upward in FIG. 6, or in a direction of decreasing the opening area of large opening section 104, by the bias force of spring 105. In addition, space 106 of which volume is varied by casing 101 and valve body 102 as valve body 102 moves is provided in opening-degree adjustment valve 100, and space 106 communicates with flow passages other than the space through communication path 107. When valve body 102 moves, because a gap is formed between valve body 102 and inner peripheral surface 101*a* of casing 101 so that refrigerant is flowed from communication path 107 into space 106 and flowed out therefrom, the resonance movement of valve body 102 comes to be restrained.

However, opening-degree adjustment valve 100 keeps an opening-degree which makes a differential pressure through opening-degree adjustment valve 100 be nearly constant. Therefore, when there exists liquid refrigerant in an evaporator of the air conditioning system for vehicle at the compressor startup, etc., it may be caused that opening-degree adjustment valve 100 operates as the compressor starts up so as to rapidly increase the opening area of the flow passage and the liquid refrigerant in the evaporator flows into the compressor at once, causing the liquid compression, so as to adversely affect the compressor. Further, a torque limiter might operate when a compressor is a clutchless compressor.

Furthermore, when the rotation speed of an engine as a drive source of the compressor increases as a vehicle runs, the discharge displacement of the variable displacement compressor increases temporarily. Until the discharge displacement has been controlled to decrease, especially in a case where the movement to control the displacement delays, the refrigerant flow rate is increased by the amount multiplied by the engine rotation speed increase and the discharge displacement, so that the power consumption increases. Therefore, there might be a bad influence on an engine control and an acceleration performance of the vehicle. As a reason why the movement to control the displacement of the compressor delays, it can be given that even if the refrigerant flow rate of the compressor increases when the engine rotation speed increases, because of the great volume of the refrigerant in the evaporator, the inner pressure fluctuation in the evaporator can be restrained and the suction pressure decrease also becomes slow. Furthermore, it can be also given as a reason why the movement to control the displacement of the compressor delays, that during a middle-low load operation, the discharge pressure decreases and the refrigerant flow rate from a discharge chamber for controlling the displacement decreases, so that the inner pressure increase in a crank chamber slows.

Patent document 1: JP-2001-289177-A

DISCLOSURE OF THE INVENTION

Problems to be Solved by the Invention

Accordingly, an object of the present invention is to provide a variable displacement compressor of which durability and reliability has been improved by preventing from a liquid compression at the time of the compressor startup, etc., and which can perform a superior response in controlling the displacement.

Means for Solving the Problems

To achieve the above-described object, a variable displacement compressor according to the present invention is a variable displacement compressor comprising an opening-degree adjustment valve, which is provided in a flow passage between a suction port and a suction hole communicating with a cylinder bore, to variably control an opening area of the flow passage, characterized in that a resistance against a movement of a valve body of the opening-degree adjustment valve in a direction of increasing the opening area of the flow passage is made to be greater than a resistance against a movement in a direction of decreasing the opening area.

In the present invention, because the resistance against the movement of the valve body in the direction of increasing the opening area of the flow passage is made to be greater than the resistance against the movement in the direction of decreasing the opening area, even if there exists liquid refrigerant at the compressor startup, etc., an inconvenience that the liquid refrigerant is sucked into the compressor at once is prevented, so that the liquid compression can be surely prevented. In addition, because the resistance through the opening-degree adjustment valve is greater in the direction of increasing the opening area of the flow passage, the pressure loss in a downstream site increases when the engine rotation speed increases. Therefore, because the differential pressure between the internal pressure of the crank chamber and the internal pressure of the suction chamber increases, the discharge displacement can decrease quickly to decrease an excessive power generation, so that the response of the displacement control can be improved.

It is possible that the above-described opening-degree adjustment valve comprises a casing placed in the flow passage and a valve body which is provided movably relative to the casing and which is urged by a spring in the direction of decreasing the opening area. In such a composition, when the opening area of the flow passage increases, the valve body is moved in the direction of increasing the opening area of the flow passage against the spring which urges in the direction of decreasing the opening area of the flow passage. And when the valve body is moved in the direction of decreasing the opening area of the flow passage, the valve body is quickly moved by the spring. Therefore, the resistance against the movement of the valve body in the direction of increasing the opening area of the flow passage can be easily made greater than the resistance against the movement in the direction of decreasing the opening area.

It is preferable that a space of which volume is varied by the casing and the valve body in accordance with an increase/decrease of the opening area of the flow passage is formed in the opening-degree adjustment valve. And, it is preferable that a communication path capable of communicating between the space and the flow passage positioned outside the space and a valve mechanism which closes the communication path when the opening area is increased and which opens the communication path when the opening area is decreased are provided. In such a structure, when the opening area of the flow passage is decreased, because the communication path is opened by the valve mechanism and refrigerant is flowed into the space, the valve body can be moved quickly in a direction of decreasing the opening area of the flow passage.

The valve body can be provided slidably relative to the casing. In this case, it is sufficient that a sliding resistance of the valve body for a direction of increasing the opening area of the flow passage is made to be greater than a sliding resistance of the valve body for a direction of decreasing the opening area.

The sliding resistance can be adjusted, for example, by interposing a sliding member between the valve body and the casing. As the sliding member, a ring-shaped resin member extending in a circumferential direction of the valve body or a lip-shaped rubber member extending in a circumferential direction of the valve body can be employed, for example.

If the opening-degree adjustment valve is formed to be a valve having a function for throttling to narrow down the flow passage, which means a suction passage, a suction pulse generated from a vibration of the suction valve transmitted to an evaporator, etc. can be reduced by the function for throttling of the suction passage.

Such a structure of the opening-degree adjustment valve in the variable displacement compressor according to the present invention is applicable to every variable displacement compressor provided with this kind of opening-degree adjustment valve. Specifically, it is suitable as a variable displacement compressor which is provided in a refrigeration circuit of an air conditioning system for vehicles, and which requires to prevent from a delay of the movement for controlling the displacement of a compressor which might adversely affect on the control of an engine as a drive source of the compressor and on a acceleration performance of a vehicle.

Effect According to the Invention

In the variable displacement compressor according to the present invention, because the resistance against the movement of the valve body of the opening-degree adjustment valve in the direction of increasing the opening area of the flow passage is greater than the resistance against the movement in the direction of decreasing the opening area at the compressor startup, etc., an inconvenience that the liquid refrigerant in the evaporator in the refrigeration circuit is sucked into the compressor at once is prevented, so that the liquid compression can be surely prevented. In addition, because the resistance through the opening-degree adjustment valve is greater in the direction of increasing the opening area of the flow passage, when the rotation speed of the engine as a drive source of the compressor increases, the pressure loss in a downstream site of the opening-degree adjustment valve increases and the displacement decreases quickly. Therefore, the excess power generation can be reduced and the response of the displacement control can be improved.

EXPLANATION OF SYMBOLS

Figure 1:
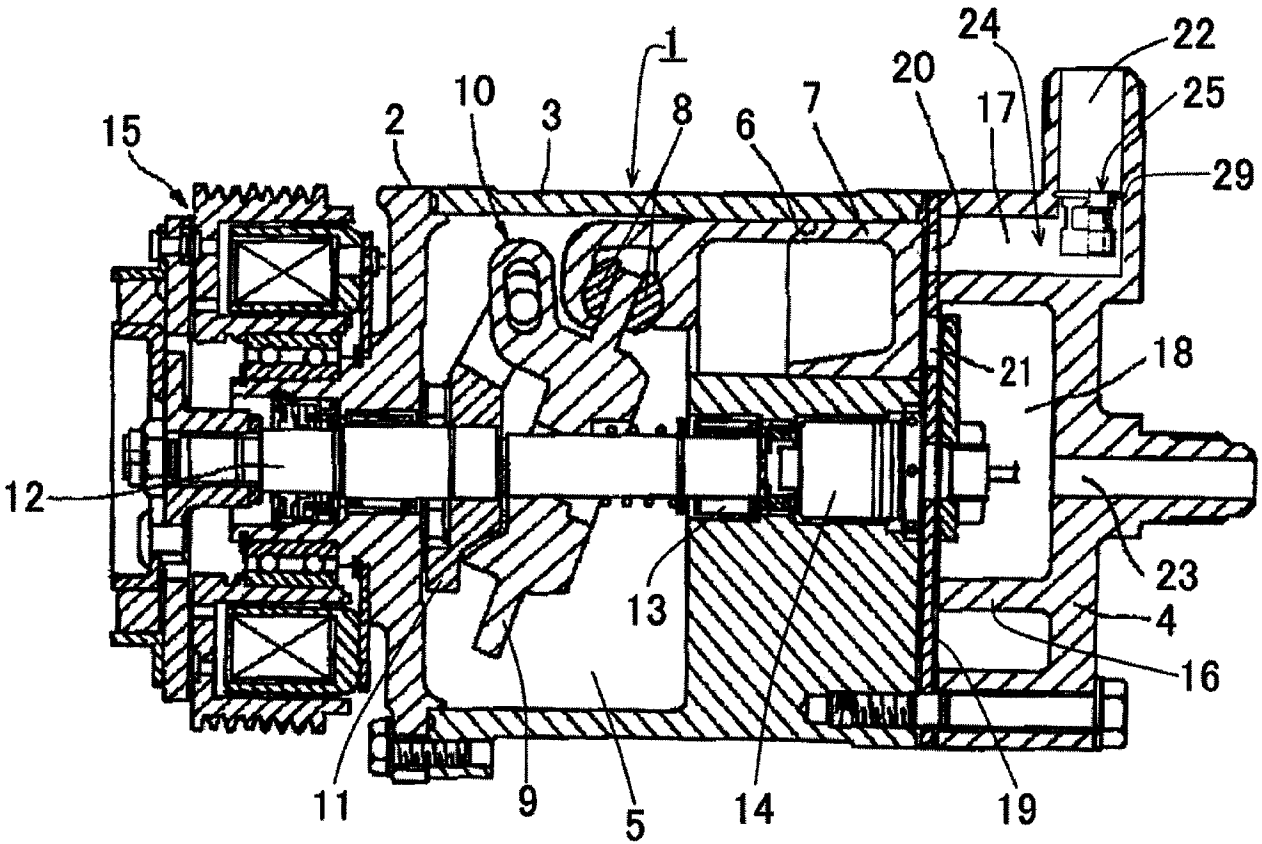
FIG. 1 is a vertical sectional view of a variable displacement compressor according to the first embodiment of the present invention.

1: variable displacement compressor
2: front housing
3: cylinder block
4: cylinder head
5: crank chamber
6: cylinder bore

7: piston
8: shoe
9: swash plate
10: hinge mechanism
11: rotor
12: drive shaft
13: radial bearing
14: displacement control valve
15: clutch mechanism
16: inner wall
17: suction chamber
18: discharge chamber
19: valve plate
20: suction hole
21: discharge hole
22: suction port
23: discharge port
24: flow passage from suction port to suction hole
25, 35, 38 opening-degree adjustment valve
26: casing
26*a*: brim section of casing
26*b*: inner peripheral surface of casing
27: spring
28: valve body
29: groove
30: small opening section
31: large opening section
32: space
33: communication path
34: valve mechanism
36: groove
37: ring-shaped resin member
39: lip-shaped rubber member

THE BEST MODE FOR CARRYING OUT THE INVENTION

Hereinafter, desirable embodiments of a variable displacement compressor according to the present invention will be explained referring to figures.

FIG. 1 shows a variable displacement compressor according to the first embodiment of the present invention. Besides, variable displacement compressors in the embodiments to be described are composed as variable displacement compressors used for a refrigeration circuit of air conditioning system for vehicles. In FIG. 1, variable displacement compressor 1 has front housing 2, cylinder block 3 and cylinder head 4. Crank chamber 5 is formed between front housing 2 and cylinder block 3. Plural cylinder bores 6 are provided along a circumferential direction. Piston 7 is inserted reciprocably in each cylinder bore 6. Swash plate 9 contacts slidably with one end of piston 7 through a pair of shoes 8. Swash plate 9 of which inclination angle is provided to be variable is coupled with rotor 11 which rotates integrally with drive shaft 12 through hinge mechanism 10. A stroke of piston 7 is altered by changing the inclination angle of swash plate 9, so that the discharge displacement of the compressor is changed.

One end of drive shaft 12 is supported rotatably by radial bearing 13 fixed to cylinder block 3. In addition, displacement control valve 14 which controls the discharge displacement is provided in cylinder block 3. Clutch mechanism 15 is provided at the other end of drive shaft 12, and the driving force from an engine, which is not shown, is transmitted to drive shaft 12 or interrupted therefrom, in accordance with ON/OFF of clutch mechanism 15, respectively.

Inside of cylinder head 4 is sectioned into suction chamber 17 and discharge chamber 18 by inner wall 16. Valve plate 19 is provided between cylinder block 3 and cylinder head 4, and suction hole 20 corresponding to each cylinder bore 6 and discharge hole 21 are bored on valve plate 19.

Refrigerant sucked from suction port 22 connected to the low pressure side of the refrigeration circuit into suction chamber 17 is sucked into cylinder bore 6 through suction hole 20, and the refrigerant which has been compressed in cylinder bore 6 by reciprocation movement of piston 7 is discharged into discharge chamber 18 through discharge hole 21. Discharge port 23 is communicated with discharge chamber 18, and discharge port 23 is connected to the high pressure side of the refrigeration circuit.

Figure 2:
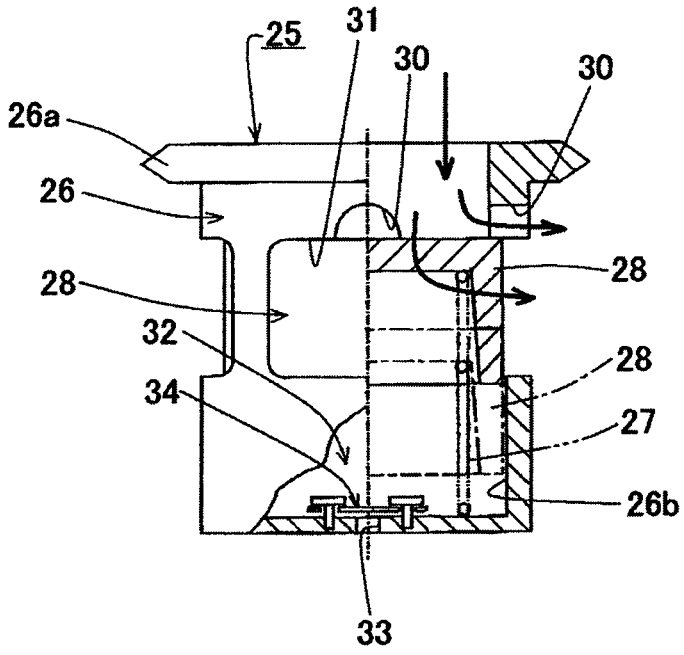
FIG. 2 is an enlarged sectional view of an opening-degree adjustment valve of the variable displacement compressor in FIG. 1.

In flow passage 24 which extends from suction port 22 via suction chamber 17 to suction hole 20, opening-degree adjustment valve 25 which controls the opening area of flow passage 24 is provided. As shown in FIG. 2, opening-degree adjustment valve 25 has casing 26 and valve body 28, where casing 26 is disposed in flow passage 24 at the bottom end of suction port 20 in this embodiment and valve body 28 is provided movably with respect to casing 26 and urged in a direction of decreasing the opening area of flow passage 24 by spring 27. In this embodiment, brim section 26*a* of casing 26 is fitted into groove 29 provided at the bottom end of suction port 22.

Small opening section 30 and large opening section 31 are provided in casing 26 of opening-degree adjustment valve 25. And valve body 28 is urged by spring 27 in a direction of closing large opening section 31, which means a direction of decreasing the opening area of flow passage 24. Further, even in a condition where valve body 28 is urged in a direction of decreasing an opening area of flow passage 24 by spring 27, small opening section 30 is always opened without closing.

Furthermore, in opening-degree adjustment valve 25, space 32 whose volume is altered in accordance with the increase and decrease of the opening area of flow passage 24 is formed with casing 26 and valve body 28. Space 32 is communicated with a flow passage outside the space through communication path 33 provided at the bottom of casing 26. Valve mechanism 34 is provided in communication path 33. In opening-degree adjustment valve 25, when refrigerant is sucked through suction valve 20 into cylinder bore 6 and the pressure at the downstream site of opening-degree adjustment valve 25 decreases, valve body 28 is moved downward in FIG. 2 against the biasing force of spring 27, so that the opening area of large opening section 31 increases and the opening area of flow passage 24 increases. In this state, though communication path 33 is closed by valve mechanism 34, refrigerant in space is permitted to discharge from a gap, between valve body 28 and inner surface 26*b* of casing 26. However, because communication path 33 is closed by valve mechanism 34, the discharge speed of refrigerant in space 32 becomes slow, and the resistance against the increase of the opening area of flow passage 24 increases. On the other hand, when the suction pressure of refrigerant falls, valve body 28 is moved upward in FIG. 2 by the spring force of spring 27, so that the opening area of large opening section 31 decreases and the opening area of flow passage 24 decreases. And when valve body 28 is moved in a direction of decreasing the opening area of flow passage 24, communication path 33 is opened by valve mechanism 34 and space 32 is communicated with other flow passages, so that the refrigerant is flowed into space 32. Therefore, by the force of spring 27 and refrigerant which is flowed into space 32, valve body 28 is moved in a direction of decreasing the opening area of flow passage 24 immediately. In other words, the resistance against the movement of valve body 28 in the direction of increasing the opening area of flow passage 24 is greater than the resistance against the movement in the direction of decreasing the opening area of flow passage 24.

Figure 5:
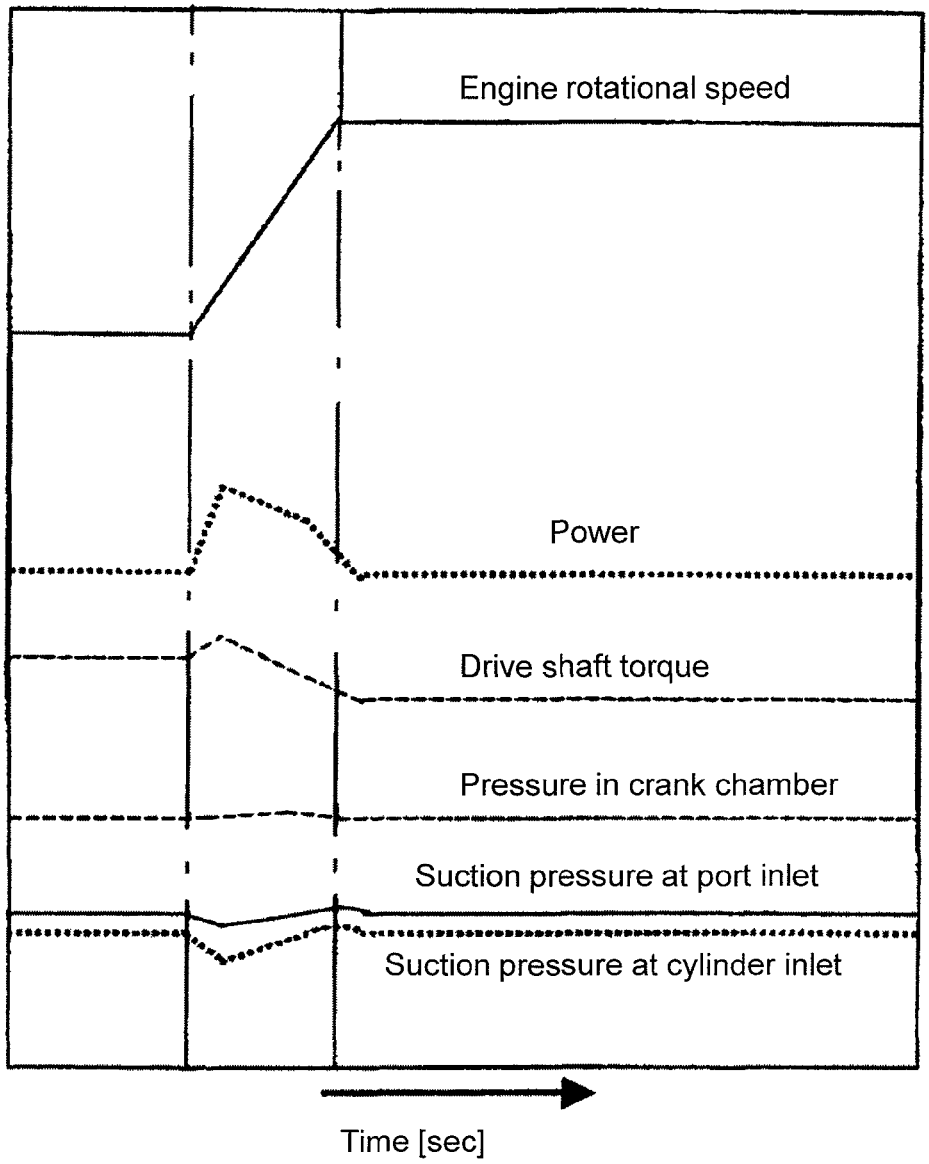
FIG. 5 is a characteristic diagram, showing compressor power, shaft torque, pressure in the crank chamber and the suction pressure change when the engine rotational speed increased for the variable displacement compressor shown in FIG. 1.
Figure 6:
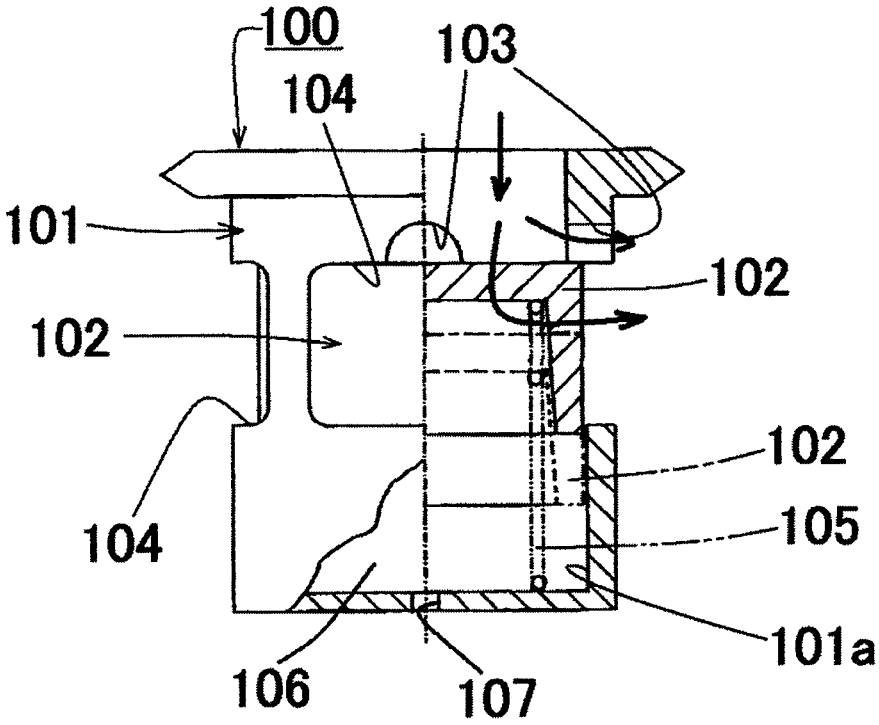
FIG. 6 is an enlarged sectional view of a opening-degree adjustment valve of a conventional variable displacement compressor.
Figure 7:
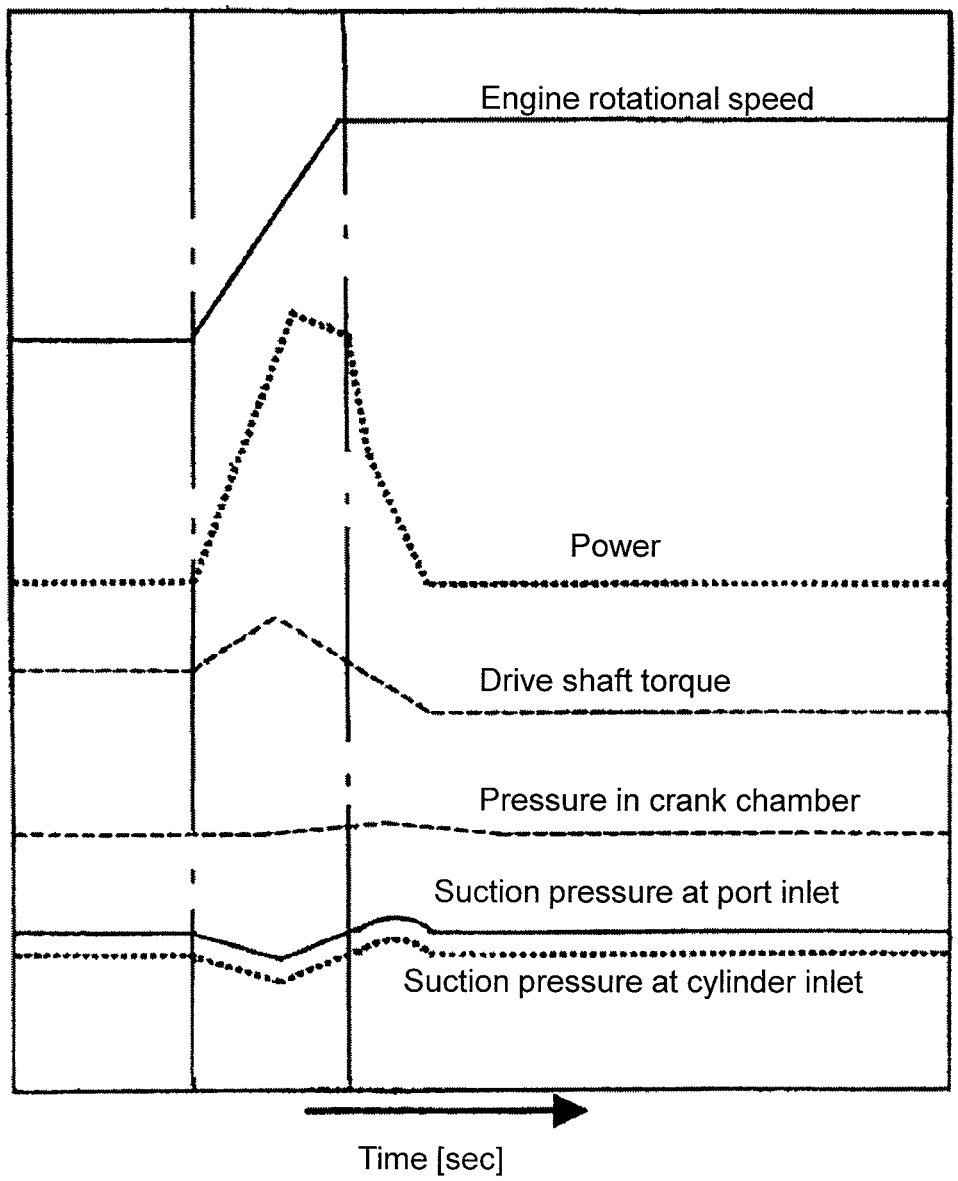
FIG. 7 is a characteristic diagram, showing compressor power, shaft torque, pressure in the crank chamber and the suction pressure change when the engine rotational speed increases for the variable displacement compressor shown in FIG. 6.

In this embodiment, because the resistance against the movement of valve body 28 in the direction of increasing the opening area of flow passage 24 is greater than the resistance against the movement in the direction of decreasing the opening area, even if there exists liquid refrigerant in the evaporator at the compressor startup, etc., such an inconvenience that the liquid refrigerant is sucked at once into the compressor is prevented and the liquid compression can be surely prevented. In addition, the resistance through opening-degree adjustment valve 25 in the direction of increasing the opening area of flow passage 24 is greater. Therefore as shown in FIG. 5, because the pressure loss at the downstream site of opening-degree adjustment valve 25 increases when the engine rotation speed increases, in a variable displacement compressor of which the differential pressure between the inner pressure of the crank chamber and suction pressure is controlled so as to keep nearly constant, the differential pressure increases and the discharge displacement is reduced immediately. Therefore, the generation of excessive power can be reduced and the response to control the displacement can be improved.

Figure 3:
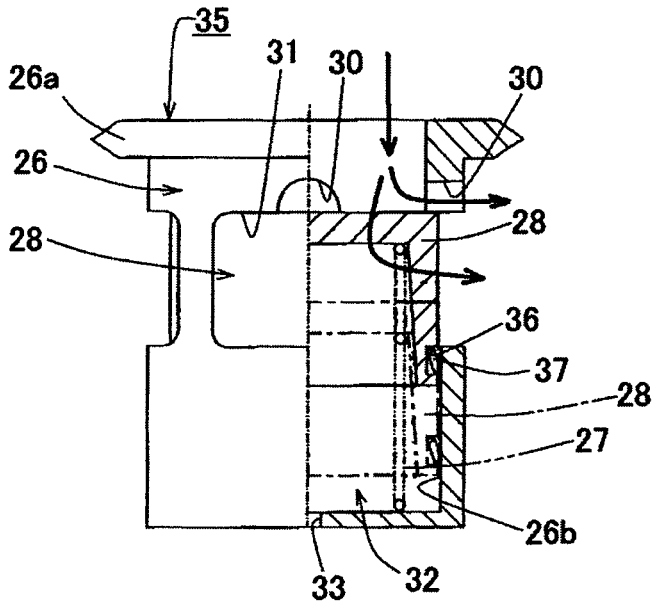
FIG. 3 is an enlarged sectional view of an opening-degree adjustment valve according to the second embodiment of the present invention.

FIG. 3 shows opening-degree adjustment valve 35 of a variable displacement compressor according to the second embodiment of the present invention. Besides, because opening-degree adjustment valve 25 in the first embodiment is the same as opening-degree adjustment valve 35 as to an essential structure, the explanation will be omitted by giving the same number to the same member. In this embodiment, valve body 28 is provided slidably with respect to casing 26, and the sliding resistance of valve body 28 is greater in the direction of increasing the opening area of flow passage 24 than that in the direction of decreasing the opening area thereof. In this embodiment, groove 36 extending along the circumferential direction on the external surface of valve body 28 is formed, and ring-shaped resin member 37 is fitted into groove 36. The sliding resistance of valve body 28 can be controlled by ring-shaped resin member 37.

Ring-shaped resin member 37 is fitted into groove 36 as protruding its bottom end toward the side of inner peripheral surface 26*b* of casing 26 as shown in FIG. 3. In such a structure, because valve body 28 slides as the bottom end of ring-shaped resin member 37 scratches the inner peripheral surface 26*b* of casing 26 when valve body 28 moves downward in FIG. 3, which means a direction of increasing the opening area of the flow passage, the sliding resistance of valve body 28 is greater in the direction of increasing the opening area of flow passage 24 than that in the direction of decreasing the opening area.

Even in this embodiment, because the resistance against the movement of valve body 28 in the direction of increasing the opening area of flow passage 24 is greater than the resistance against the movement in the direction of decreasing the opening area, the liquid compression is prevented according to the function of the first embodiment and the displacement control responsiveness at the time of increase of the engine rotational speed can be improved.

As well, this embodiment can be combined with the first embodiment. Such a combination makes it possible to prevent the liquid compression more efficiently and to improve the displacement control responsiveness further in a case of the increase of the engine rotational speed.

Figure 4:
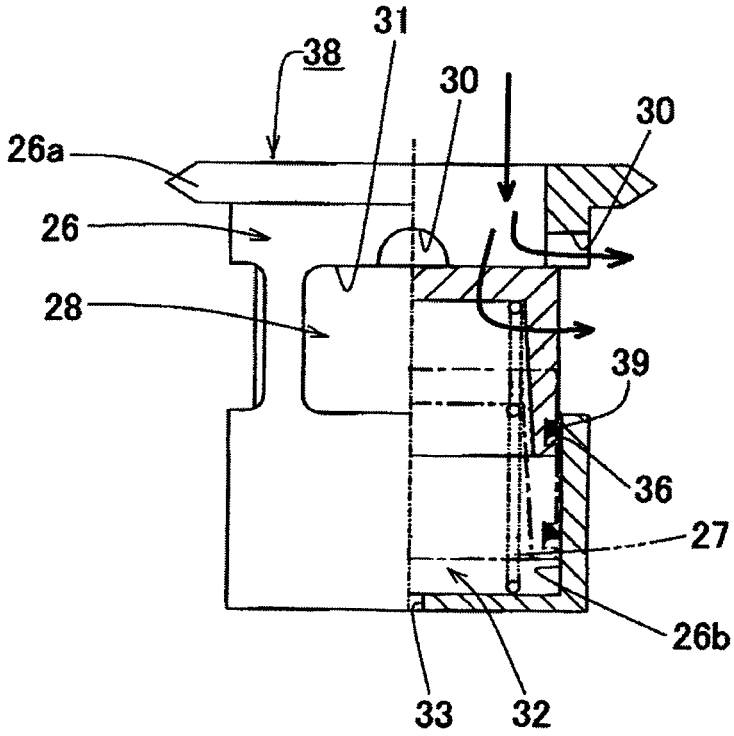
FIG. 4 is an enlarged sectional view of an opening-degree adjustment valve according to the third embodiment of the present invention.

FIG. 4 shows opening-degree adjustment valve 38 of a variable displacement compressor according to the third embodiment of the present invention. Besides, because opening-degree adjustment valve 25 in the first embodiment is the same as opening-degree adjustment valve 38 about an essential structure, the explanation will be omitted by giving the same number to the same member. In this embodiment, valve body 28 is provided slidably with respect to casing 26, and the sliding resistance of valve body 28 is greater in the direction of increasing the opening area of flow passage 24 than that in the direction of decreasing the opening area thereof. In this embodiment, groove 36 extending along the circumferential direction on the external surface of valve body 28 is formed, and lip-shaped rubber member 39 is fitted into groove 36. The sliding resistance of valve body 28 can be controlled by lip-shaped rubber member 39.

Lip-shaped rubber member 39 is fitted into groove 36 as protruding its tip side toward the side of inner peripheral surface 26*b* of casing 26 as shown in FIG. 4. In such a structure, when valve body 28 moves downward in FIG. 4, which means a direction of increasing the opening area, a seal structure is formed between the tip of lip-shaped rubber member 39 and inner peripheral surface 26*b* of the casing, so that the gas in space 32 can be discharged only from communication path 33. On the other hand, when valve body moves upward in FIG. 4, which means a direction of decreasing the opening area, the sealing performance of a gap between the tip of lip-shaped rubber member 39 and inner peripheral surface 26*b* of the casing reduces, so that gas enters space 32 even through the gap. Therefore, the sliding resistance of valve body 28 is greater in the direction of increasing the opening area of flow passage 24 than that in the direction of decreasing the opening area thereof. Even in this embodiment, because the resistance against the movement of valve body 28 in the direction of increasing the opening area of flow passage 24 is greater than the resistance against the movement in the direction of decreasing the opening area, the liquid compression is prevented according to the function of the first embodiment and the displacement control responsiveness at the time of increase of the engine rotational speed can be improved.

As well, this embodiment can be combined with the first embodiment. Such a combination makes it possible to prevent the liquid compression more efficiently and to improve the displacement control responsiveness further at the increase of the engine rotational speed.

INDUSTRIAL APPLICATIONS OF THE INVENTION

A variable displacement compressor according to the present invention is applicable to a variable displacement compressor having an opening-degree adjustment valve, and is specifically suitable as a variable displacement compressor provided in an refrigeration circuit of an air conditioning system for vehicles.

The invention claimed is:

1. A variable displacement compressor comprising an opening-degree adjustment valve, which is provided in a flow passage between a suction port and a suction hole communicating with a cylinder bore, to variably control an opening area of said flow passage, wherein said opening-degree adjustment valve comprises a casing placed in said flow passage and a valve body which is provided movably relative to said casing and which is urged by a spring in said direction of decreasing said opening area; and wherein a space of which volume is varied by said casing and said valve body in accordance with an increase/decrease of said opening area of said flow passage is formed, and a communication path capable of communicating between said space and said flow passage positioned outside said space and a valve mechanism which closes said communication path when said opening area is increased and which opens said communication path when said opening area is decreased are provided, said communication path is disposed at a bottom of said casing.

2. The variable displacement compressor according to claim 1, wherein said valve body is provided slidably relative to said casing, and a sliding resistance of said valve body for a direction of increasing said opening area of said flow passage is made to be greater than a sliding resistance of said valve body for a direction of decreasing said opening area.

3. The variable displacement compressor according to claim 2, wherein a sliding member which is capable of controlling said sliding resistance is interposed between said valve body and said casing.

4. The variable displacement compressor according to claim 3, wherein said sliding member is a ring-shaped resin member extending in a circumferential direction of said valve body.

5. The variable displacement compressor according to claim 3, wherein said sliding member is a lip-shaped rubber member extending in a circumferential direction of said valve body.

6. The variable displacement compressor according to claim 1, wherein said opening-degree adjustment valve is a valve having a function for throttling to narrow down said flow passage.

7. The variable displacement compressor according to claim 1, wherein said compressor is provided in a refrigeration cycle of an air conditioning system for vehicles.

* * * * *